United States Patent [19]

Smith et al.

[11] 4,165,680

[45] Aug. 28, 1979

[54] FUME EXTRACTION CANOPY WITH BAFFLE DEFLECTOR

[75] Inventors: Charles G. Smith, West Bromwich; Kenneth R. Parker, Sutton Coldfield; John G. Wyatt, Birmingham, all of England

[73] Assignee: Dresser Industries, Inc., Dallas, Tex.

[21] Appl. No.: 960,495

[22] Filed: Nov. 13, 1978

[51] Int. Cl.[2] ..... F23J 11/00

[52] U.S. Cl. ..... 98/115 R; 52/72; 52/200; 55/307; 55/385 D; 55/465; 126/280; 126/299 R; 209/137; 209/138; 266/144; 266/158

[58] Field of Search ..... 75/5, 4, 3, 10 R, 60; 266/144, 145, 156, 157, 158, 159; 202/263; 126/299 R, 299 F, 180; 98/115 R, 115 LH, 11 SB, 115 VM, 42 R; 209/133, 137, 138, 139 R, 454, 457; 55/307, 308, 385 D, 385 F, 465; 52/302, 303, 305, 200, 72

[56] References Cited

U.S. PATENT DOCUMENTS

| | | | |
|---|---|---|---|
| 3,336,854 | 8/1967 | Knutson et al. | 98/42 |
| 3,972,782 | 8/1976 | Patton | 202/263 |
| 4,127,106 | 11/1978 | Jensen | 126/299 D |

FOREIGN PATENT DOCUMENTS 1396083 5/1975 United Kingdom .

*Primary Examiner*—L. Dewayne Rutledge
*Assistant Examiner*—Michael L. Lewis
*Attorney, Agent, or Firm*—Paul E. Krieger

[57] ABSTRACT

A fume extraction assembly comprises an elevated canopy adapted to collect fume; and elongated outlet means offset from an apex of the canopy and having gas flow characteristics compensating for a tendency to uncontrolled extraction rates along said outlet means.

7 Claims, 6 Drawing Figures

FUME EXTRACTION CANOPY WITH BAFFLE DEFLECTOR

This invention is concerned with improvements in or relating to fume extraction.

In industry, fume emitted from various sources is collected and extracted via a canopy. The ideal shape of canopy is believed to be in the form of a sharp pitched conical or pyramidal hood with a vertical fume outlet at the apex. Alternatively, a horizontally elongated canopy may be provided with a pitched roof portion; preferably the angle of pitch of the roof portion is less than 90°.

However, height considerations sometimes dictate a flatter canopy profile, which it has been found can lead to problems of non-uniformly distributed fume extraction rates, requiring excessive power consumption to achieve adequate fume extraction from the areas of lower extraction rate. Apart from the increased power consumption which this involves, it also leads to excessive final gas volumes and the increased entrainment of atmospheric air resulting from the higher overall extraction rate necessary to compensate for the areas of lower extraction rate. In some instances in areas remote from the off-take fume can escape from the canopy altogether.

The economic effects of these disadvantages are specially important where generally high gas volumes are involved as, for example, in the case of secondary ventilation systems in the steel industry. For example, in buildings where basic oxygen steel-making is carried out or electric arc furnace shops, the extracted gas volumes may be in excess of one million cubic feet per minute, and the high power consumption involved in handling such volumes will be readily appreciated.

It is an object of the present invention to provide an improved fume extraction assembly.

The invention provides a fume extraction assembly which comprises (a) an elevated canopy adapted to collect fume, and (b) elongated outlet means offset from an apex of the canopy and having gas flow characteristics compensating for a tendency to uncontrolled extraction rates along said outlet means.

The invention also provides a method of extracting fume using an assembly according to the invention; the fume emanating, for example, from a metallurgical process, e.g. iron or steel making.

There now follows a description, to be read with reference to the accompanying diagrammatic drawings, of fume extraction assemblies embodying the invention. This description, which is illustrative of apparatus and method aspects of the invention, is given by way of example only and not by way of limitation of the invention.

Figure 1:
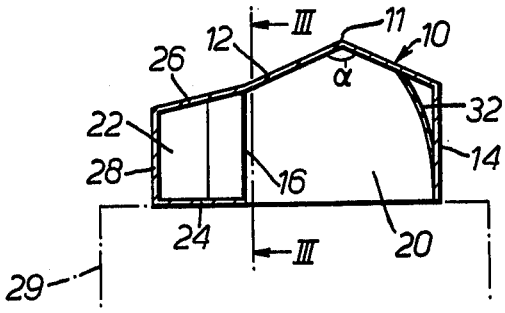
FIG. 1 shows an end view of a first assembly embodying the invention.

The first fume extraction assembly embodying the invention (FIGS. 1 and 2) is located in a building (not shown) and comprises an elongated canopy 10 elevated above floor level and adapted to collect fume emanating e.g. from a steel-making process carried out in the building, such as basic oxygen steel-making or an electric arc furnace. The canopy 10 is rectangular in plan view and comprises vertical side walls 14, 16, and vertical end walls 18, 20. The canopy 10 comprises a pitched roof 12 extending between the side walls 18, 20 with an angle of pitch ($\alpha$) greater than 90°.

An extraction duct 22 offset (FIG. 1) from the apex 11 of the canopy extends along the side wall 16 from the end wall 20 to the end wall 18 below the level of the roof 12, and then leads via an extraction fan (not shown) to gas cleaning plant (not shown); alternatively the extraction fan may be downstream of the gas cleaning plant. Fume extracted via the canopy 10 and duct 22 is discharged to the atmosphere following treatment in the gas cleaning plant. The duct 22 comprises (in cross-section) a horizontal base wall 24, an outwardly downwardly sloping top wall 26, and a vertical outer side wall 28; the side wall 16 defines a boundary between the duct 22 and the canopy 10, and the side wall 28 diverges from the side wall 16 in the downstream direction from the region of the end wall 20 to the region of the end wall 18, where the cross-section of the duct 22 becomes uniform; it will be realised that as the side wall 16 diverges so the cross-section of the duct 22 increases.

The side wall 16 is provided with a plurality of parallel uniformly spaced vertical slots 30, each of which extends longitudinally for the full height of the side wall 16. Each slot 30 after the one closest to the end wall 20 is narrower (as viewed in FIGS. 2 and 3) than the preceding upstream slot 30; or instead of each slot 30 being narrower than the preceding one the slots may be provided in banks each comprising a plurality of adjacent slots of uniform width, but the slot width narrowing from bank to bank; it will be realised that in either case the slot width narrows progressively in the downstream direction. In a modification, the slot width is uniform throughout, but they are spaced progressively wider apart in the downstream direction.

With uniformly spaced slots 30 the uniform spacing between adjacent slots is, for example, 1 to 3 feet with a minimum slot width of 2 inches. In a more specific example the spacing is 2 feet with a slot width decreasing from 36 inches to 3 inches over a 200 foot long canopy.

With a uniform slot width the dimensions are complementary to the above, e.g. a uniform slot width of from 1 to 3 feet and a minimum spacing of 2 inches.

The progressively narrowing slots 30 provide gas flow characteristics which compensate for a tendency to uncontrolled non-uniform extraction rates along the side wall 16. It will be realised this tendency is towards increased extraction rates at the downstream end of the wall 16, and progressively reduced extraction rates towards the upstream end; and the wider the vertical slot 30 the less resistance to gas flow it presents; hence the compensation.

The progressive downstream widening of the duct 22 provided by the diverging side wall 28 also provides gas flow characteristics which assist in compensation for the tendency to non-uniform extraction rates, since suction from the fan will be increased by reduction in the cross-sectional area of the duct 22.

In a modification, however, the outer side wall of the duct 22 is parallel to the side wall 16 as shown in chain line at 28*a*, for cases where sufficient compensation is provided by the slots 30.

The assembly also comprises, facing the slots 30, a concave curved baffle plate 32 which extends inside the canopy 10 along the full length of the side wall 14, and downwardly from the roof 12 adjacent the top of the side wall 14 to merge with a lower portion of the side wall 14. The baffle plate 32 serves to direct gas transversely from the region of the baffle plate towards the side wall 16 and the slots 30 therein. In a modification, the baffle plate is inclined planar rather than concave.

In some cases it may be desirable to provide a skirt attached to lower portions of the assembly to aid in fume entrainment; this is illustrated in chain dot at 29.

Figure 2:
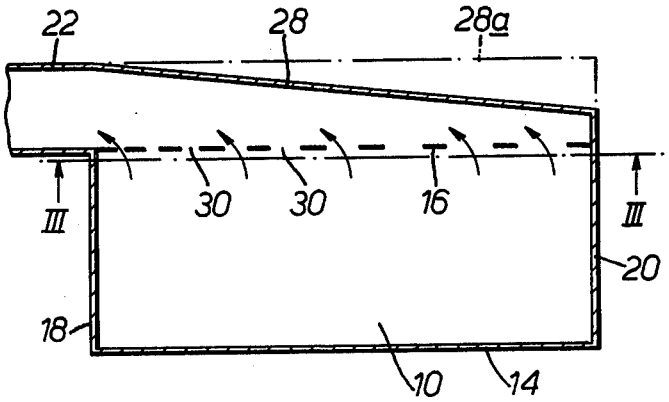
FIG. 2 shows a plan view corresponding to FIG. 1.

The second fume extraction assembly embodying the invention (FIGS. 3 and 4) resembles the assembly shown in FIGS. 1 and 2 in many respects, and is described in so far as it differs therefrom.

Figure 3:
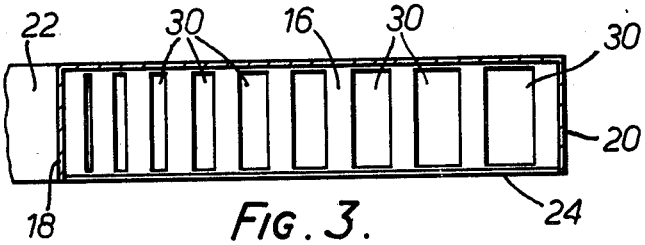
FIG. 3 is a view on the line III—III of FIG. 2.
Figure 4:
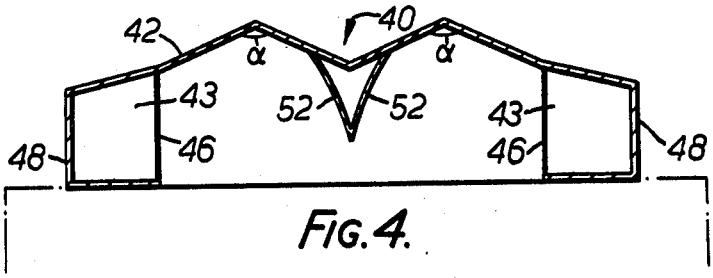
FIG. 4 shows an end view of a second assembly embodying the invention.
Figure 5:
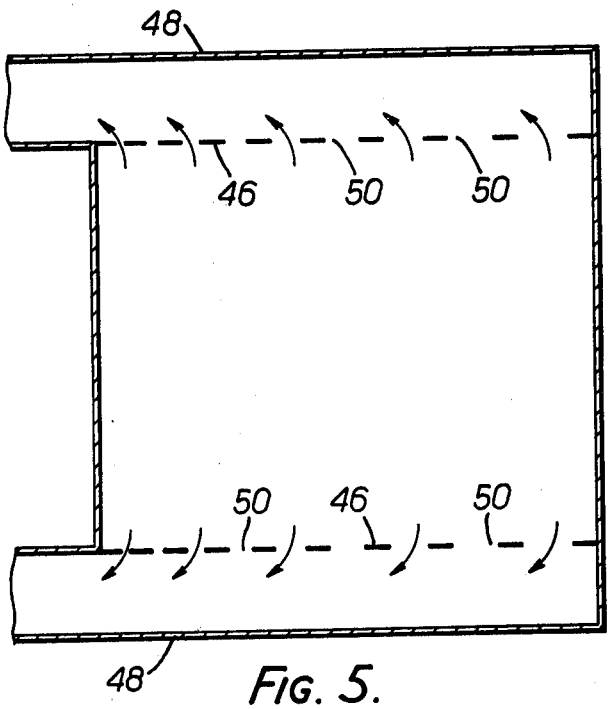
FIG. 5 shows a plan view corresponding to FIG. 4.

The assembly shown in FIGS. 3 and 4 comprises a canopy 40 comprising a twin symmetrical pitched roof 42, having an angle $\alpha$ greater than 90°. The canopy 40 comprises opposed side walls 46 each corresponding to the side wall 16 and having slots 50 corresponding to the slots 30. Ducts 43 each corresponding to the duct 22 extend along the side walls 46, and each duct 43 may have an outer side wall 48 parallel to the side walls 46 as shown in FIG. 5, or may have an inclined outer side wall corresponding to the side wall 28. Twin symmetrical baffle plates 52 corresponding generally to the baffle plate 32 are provided in a central region as viewed in FIG. 4, and the lower ends of the baffle plates 52 are connected together in merging relationship. It will be noted that each baffle plate 52 faces one of the side walls 46.

Figure 6:
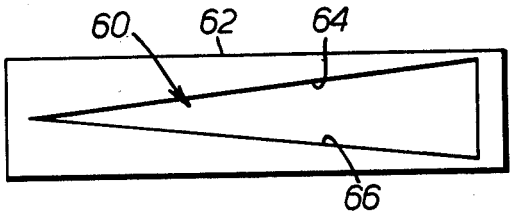
FIG. 6 shows a side view of a side wall of a third assembly embodying the invention.

The third fume extraction assembly embodying the invention (FIG. 6) resembles the first or second assembly in many respects, and is described in so far as it differs therefrom.

In the third assembly the slots 30 or 50 are replaced by a single V-shaped opening 60 in a side wall 62 corresponding to the side walls 16,46; the opening is defined by upper and lower boundaries 64,66 respectively, the vertical spacing of which varies along the side wall 62. It will be realised that the V-shaped opening converges in the downstream direction.

In other assemblies embodying the invention, smaller low height profile canopies, e.g. square or rectangular in plan view, have an extraction duct fully encircling the canopy with slots corresponding to the slots 30 suitably sized to optimize uniformity of extraction rate according to the particular conditions obtaining. In such cases, there may be more than one off-take from the encircling extraction duct, the off-takes then leading to a single further duct which itself leads towards the fan.

In appropriate cases remotely operable rotatable louvres may be provided to define and vary slot width when required; this may be useful for example where because of process conditions it is desired to extract preferentially in certain areas; this may apply, for example, when a long canopy extends over a plurality of furnaces and it is desired to extract preferentially from one furnace. In this case, for example louvres of uniform width and axial spacing may be used with a louvre width from 1 to 3 feet to give a corresponding maximum slot width also from 1 to 3 feet. It will be realised that variations in width between the several slots according to requirements is achieved by different angular settings of the louvres.

In some cases the canopy may be provided by the roof of a building itself.

We claim:

1. A fume extraction assembly which comprises:

(a) elevated canopy means for collecting fume, said canopy means comprising opposite side walls and a pitched roof extending between the side walls;

(b) elongated outlet means defining a plurality of upwardly extending slots for extracting fume from the canopy means and for compensating for a tendency to uncontrolled extraction rates along the outlet means, said outlet means extending along at least one of the side walls and being offset from the apex of the pitched roof; and (c) baffle means facing the outlet means for directing fume towards the outlet means.

2. An assembly according to claim 1, wherein the slots are of varying width.

3. An assembly according to claim 1, wherein the slots are of varying spacing.

4. An assembly according to claim 2, wherein the spacing between adjacent slots is about 1 to 3 feet with a minimum slot width of about 2 inches.

5. An assembly according to claim 3, wherein the minimum spacing between adjacent slots is about 2 inches and the slot width is about 1 to 3 feet.

6. An assembly according to claim 1, wherein the outlet means comprises an extraction duct, the cross-section of which increases in a downstream direction.

7. A fume extraction assembly, wherein the apex angle of the pitched roof is greater than about 90°.

* * * * *

UNITED STATES PATENT OFFICE

CERTIFICATE OF CORRECTION

Patent No. 4,165,680 Dated August 28, 1979

Inventor(s) Charles G. Smith et al

It is certified that error appears in the above-identified patent and that said Letters Patent are hereby corrected as shown below:

Cover Page, Assignee: delete "Dresser Industries, Inc., Dallas, Texas" and substitute therefor --Lodge Cottrell Limited, Birmingham, England--.

Signed and Sealed this

*Thirty-first* Day of *August 1982*

[SEAL]

*Attest:*

GERALD J. MOSSINGHOFF

*Attesting Officer* *Commissioner of Patents and Trademarks*